United States Patent [19]

Draxler et al.

[11] Patent Number: 4,728,041

[45] Date of Patent: Mar. 1, 1988

[54] FLUID SPRAY APPARATUS

[75] Inventors: Daniel R. Draxler, Hockley; Michael J. Woodward, Houston, both of Tex.

[73] Assignee: Weatherford U.S., Inc., Houston, Tex.

[21] Appl. No.: 38,608

[22] Filed: Apr. 15, 1987

[51] Int. Cl.[4] ..... B05B 3/16

[52] U.S. Cl. ..... 239/754; 239/263; 239/264; 239/265; 74/99 R; 74/102; 74/105

[58] Field of Search ..... 239/750, 751, 752, 753, 239/754, 746, 225.1, 264, 265, 587, 263; 74/102, 103, 110, 99 R, 105

[56] References Cited

U.S. PATENT DOCUMENTS

| | | | |
|---|---|---|---|
| 1,256,624 | 2/1918 | Westbye | 74/110 |
| 3,383,046 | 5/1968 | Voegtly | 239/186 |
| 3,690,067 | 9/1972 | Goss et al. | 51/428 |
| 3,745,868 | 7/1973 | Prentice | 83/630 |
| 4,376,443 | 3/1983 | Mondy, Jr. | 134/ |

*Primary Examiner*—Andres Kashnikow
*Assistant Examiner*—Chris Trainor
*Attorney, Agent, or Firm*—Vaden, Eickenroht, Thompson & Boulware

[57] ABSTRACT

A fluid spray apparatus for oscillating a fluid discharge head attached thereto and a self-oscillation apparatus. The fluid spary apparatus may have a mounting for receiving and holding a fluid discharge device or devices, the mounting member being pivotably connected to dual supports which are in turn movably mounted on a body member with a lost motion means so that a component of the force reacting to the fluid discharge effects oscillating movement of the fluid spray device.

19 Claims, 9 Drawing Figures

FLUID SPRAY APPARATUS

BACKGROUND OF THE INVENTION

1. Field of the Invention

This invention relates to oscillating devices and particularly to devices for oscillating or traversing fluid discharge apparatuses and to apparatus for pivoting movement of a fluid spray nozzle.

2. Description of the Prior Art

Prior art devices for cyclically moving a spray nozzle require a separate, external power supply for moving the nozzle. The need for a separate power supply necessitates the use of additional equipment such as electric generators, air compressors, or hydraulic power units. The external power supplies must interface with the spray apparatus via electrical wiring, hydraulic hoses, air hoses or other power transmission means—all of which inhibit maneuverability. The external power supplies are expensive and significant expense is also associated with their upkeep and maintenance.

SUMMARY OF THE INVENTION

The present invention discloses an improved oscillation mechanism and an improved fluid spray apparatus which overcomes the problems associated with the prior art devices. The oscillation mechanism has a traverse bar which, in the fluid spray apparatus, serves as a mount for holding the fluid discharge device, such as a spray nozzle. The mount is pivotably connected to supports such as elongated bars which are movably mounted on a body member with a lost motion opening to permit reversal of direction of motion. The bars move back and forth on the body member in response to a component of the reaction force created when fluid is discharged. Stops can be provided to limit the bars' movement and to control the extent of the spray. Weights or other damping means can be added to vary the speed and the period of the cycle. Rollers can be employed both to facilitate the movement of the support bars and to guide the bars in their movement.

It is, therefore, an object of the present invention to provide an improved mount for fluid discharge means, an improved fluid discharge means and an improved oscillation mechanism.

Another object of the present invention is the provision of a self-moving fluid discharge means.

Yet another object of the present invention is the provision of a self-moving oscillation mechanism.

Still another object of the present invention is the provision of a fluid spray apparatus which requires no separate power supply.

An additional object of the present invention is the provision of such an apparatus which has a variable frequency of movement.

Another object of the present invention is the provision of such an apparatus whose speed can be varied.

A further object of the present invention is the provision of such an apparatus which provides for control of the extent of the area to be sprayed.

To one of skill in this art who has the benefit of the present invention's teachings, other and further objects will be apparent from the following description of the presently preferred embodiments of the invention, given for the purpose of disclosure, when taken in conjunction with the accompanying drawings.

DESCRIPTION OF PREFERRED EMBODIMENTS

Figure 1:
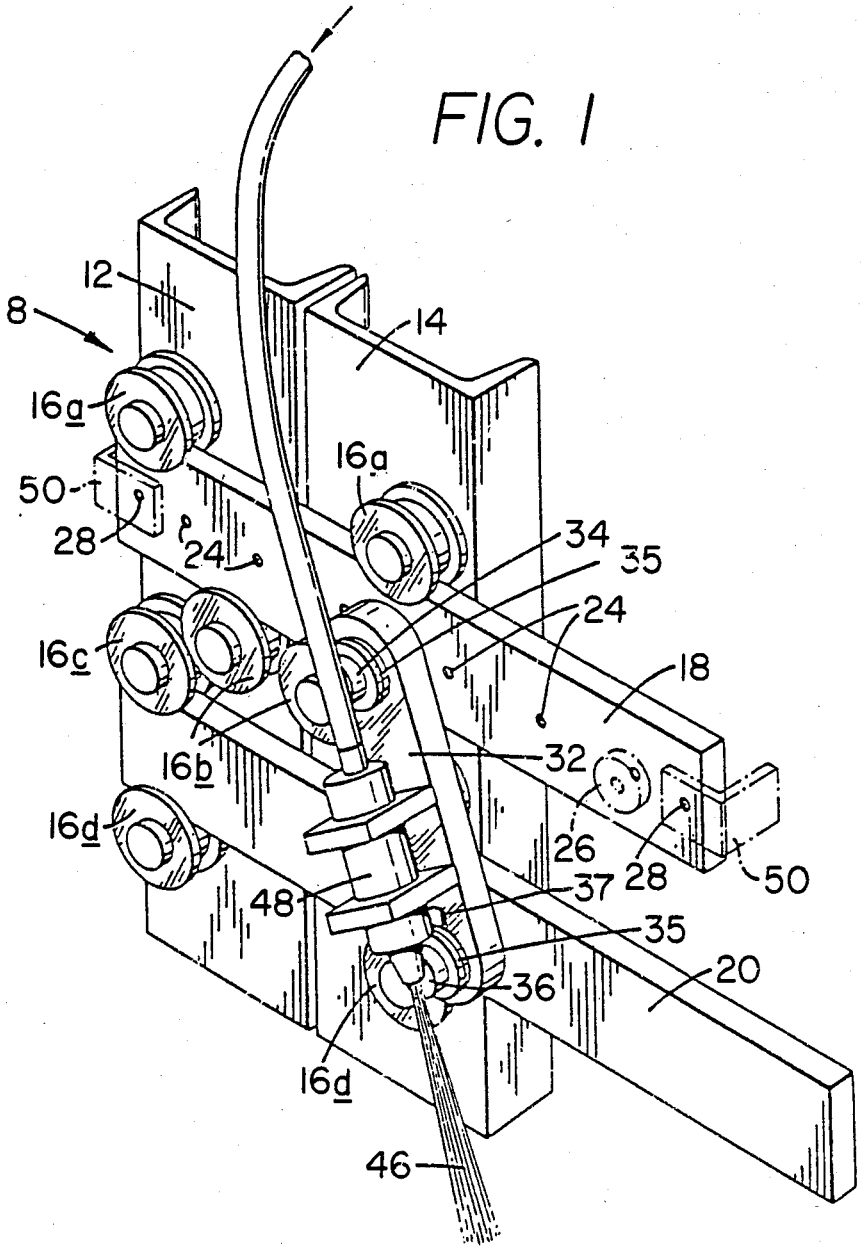
FIG. 1 is a side perspective view of an oscillation mechanism according to the present invention.
Figure 2:
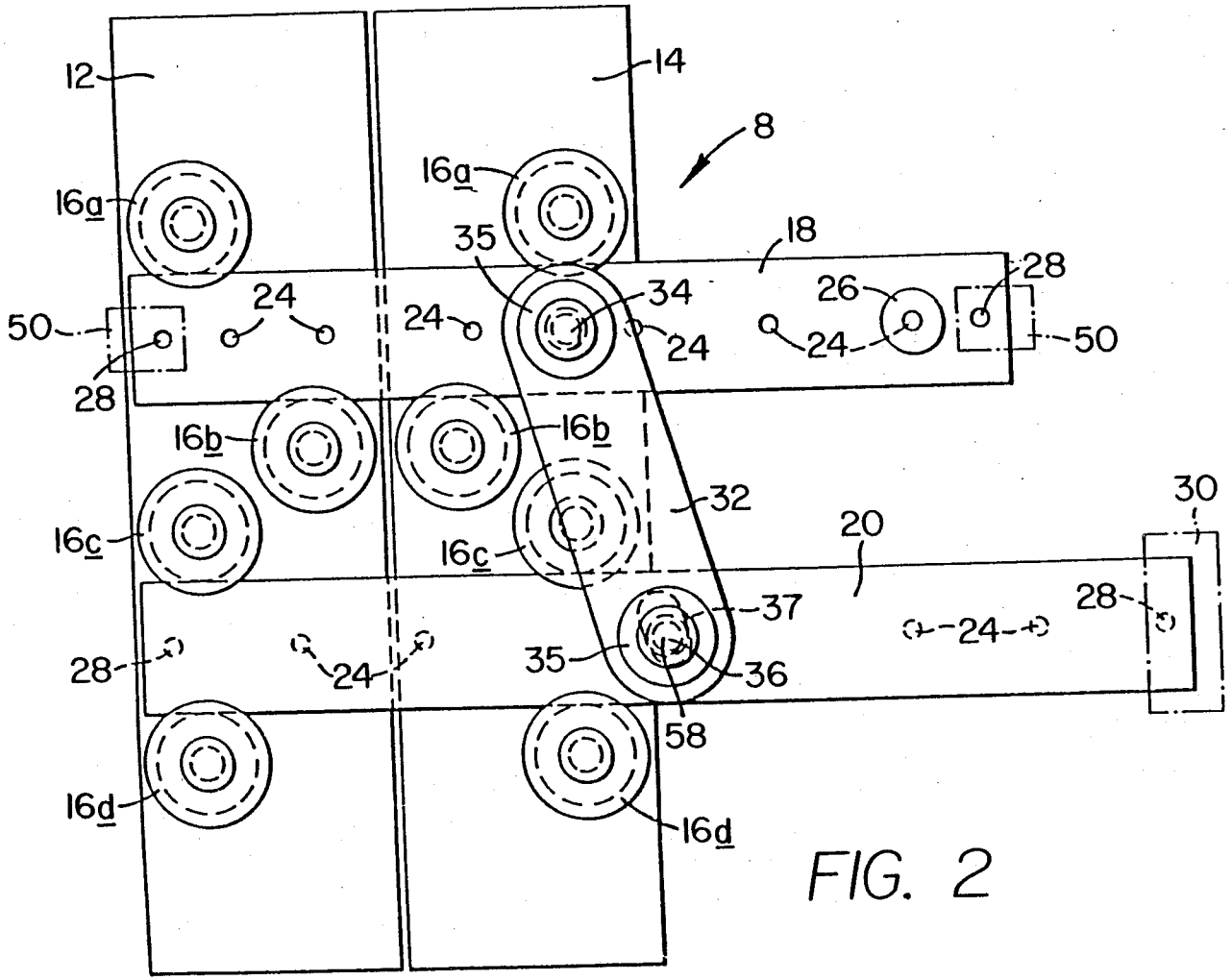
FIG. 2 is a front view of the mechanism of FIG. 1.
Figure 3:
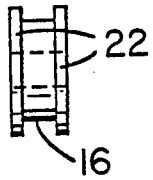
FIG. 3 is a perspective view of one of the rollers of FIG. 2.

As shown in FIGS. 1 and 2, the oscillation mechanism 8 has the left body channel 12 and the right body channel 14. The flanged rollers 16 are rotatably mounted on their respective body channels 12 and 14. The first bar support 18 is held in place and guided by the two sets of rollers **16*a* and 16*b*. The second bar support 20 is held in place and guided by the two sets of rollers 16*c* and 16*d*. Each roller 16 has flanges 22 (FIG. 3) which serve to hold and guide the bars 18 and 20**.

Each of the bars 18 and 20 has a series of holes 24 (FIG. 2). These holes 24 can be utilized to receive and hold weights to effect changes in the speed, frequency, and period of the cyclical action of the mechanism 8, such as the weight 26 as shown in FIG. 2. Also the holes 24 can be used to receive and hold abutment members, such as abutment member 30 for abutting the channels 12, 14 to serve as stops for limiting the extent of movement of the bars 18, 20; when the mechanism 8 is used with a spray device, such limitation of the movement of the bars provides control of the extent of the discharged spray.

Figure 4:
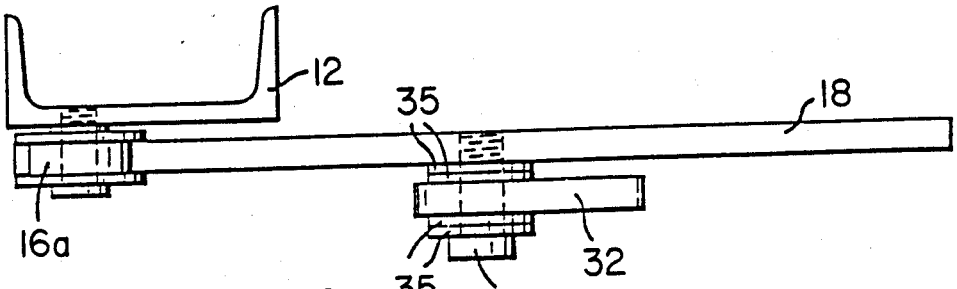
FIG. 4 is a partial top view of the mechanism of FIG. 2 showing one body channel, the top bar support, and the traverse bar.

The traverse bar 32 is pivotably connected to both the first bar support 18 (pivot point 34) and the second bar support 20 (pivot point 36). The movement of either bar will cause the traverse bar to pivot about both pivot points 34 and 36. As shown in FIGS. 1 and 4, the rollers **16*a* and 16*b* which are rotatably mounted to the body channels 12 and 14 receive and hold the first bar support 18. The traverse bar 32 is pivotably mounted to the bar 18 by means of the pin 38 extending through the traverse bar 32 and into the bar 18. The traverse bar 32 is pivotably mounted to the bar 20 by the pin 58, which pin is also movable in a lost motion slot 37 which is provided in the bar 32** to permit reversal of the direction of the bar supports and traverse bar.

In operation the mechanism 8 is so configured that movement of the bars produces the desired cyclical traversing effect. This can be accomplished, for example, by fashioning a housing 40 connected to the channel 12, 14 and disposed about the bars, the housing 40 having shoulders 42 for contacting the first bar support 18 before shoulders 44 contact the second bar abutment member 30 (FIG. 2) or stops 50 for stopping against the sides of the body channels (FIG. 1) can be employed to effect similar differential stoppage of the bars 18 and 20. Also the lengths of the bars 18 and 20 can be varied.

Figure 5:
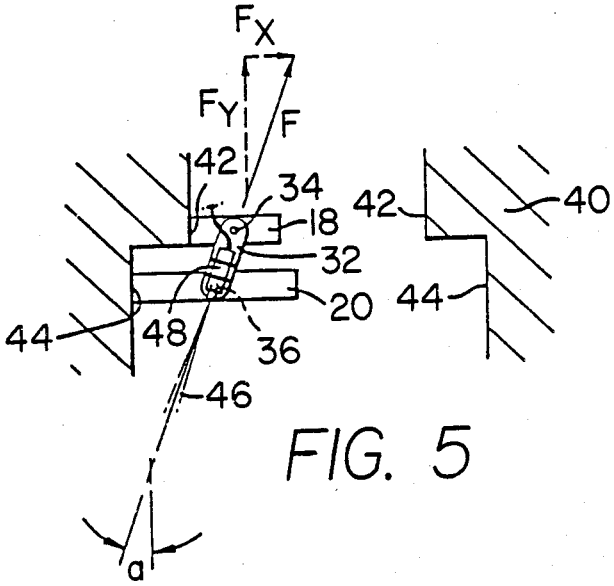
FIGS. 5–8 depict the cycle of operation of a fluid spray apparatus according to the present invention.
Figure 6:
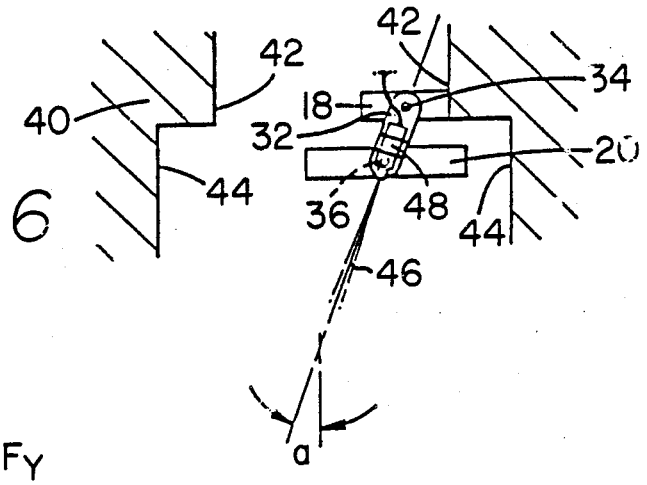
Figure 7:
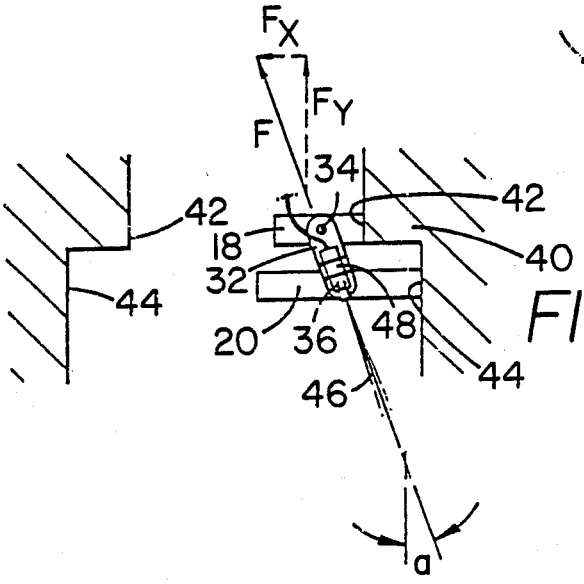
Figure 8:
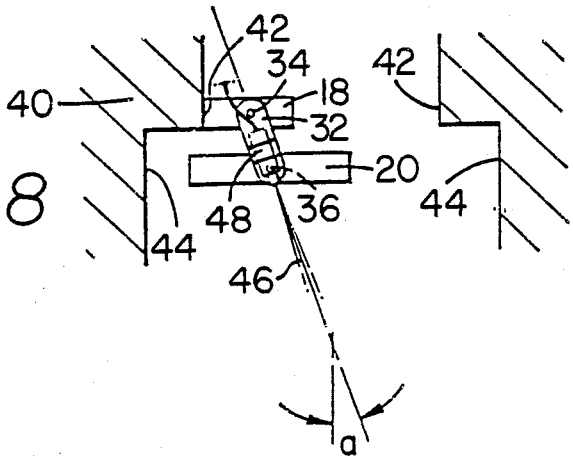

The cycle of operation of the mechanism 8 is illustrated in FIGS. 5–8. As shown in FIG. 5 a spray 46 is sprayed from the discharge device 48 mounted on the traverse bar 32. The traverse bar 32 is at an angle "a" to the bars 18, 20. The force of the spray 46 causes a reaction force F to be applied to the mechanism.

The horizontal component of this force $F_x$, is available to accelerate bars 18 and 20 to the right until bar 18 reaches its physical stop against shoulder 42 of housing 40 (or in other embodiments until stops contact body channels). At this time, (FIG. 6), bar 18 stops, while inertia drives bar 20 to the right and the traverse bar 32 pivots about point 34, thereby changing the spray direction to that shown in FIG. 7. Now the horizontal component of "F" is directed to the left (FIG. 7) and the mechanism accelerates to the left until reaching the state shown in FIG. 8. Again bar 18 reaches a stop, the traverse bar 32 pivots, and once bar 20 reaches its stop, the cycle is complete.

Figure 9:
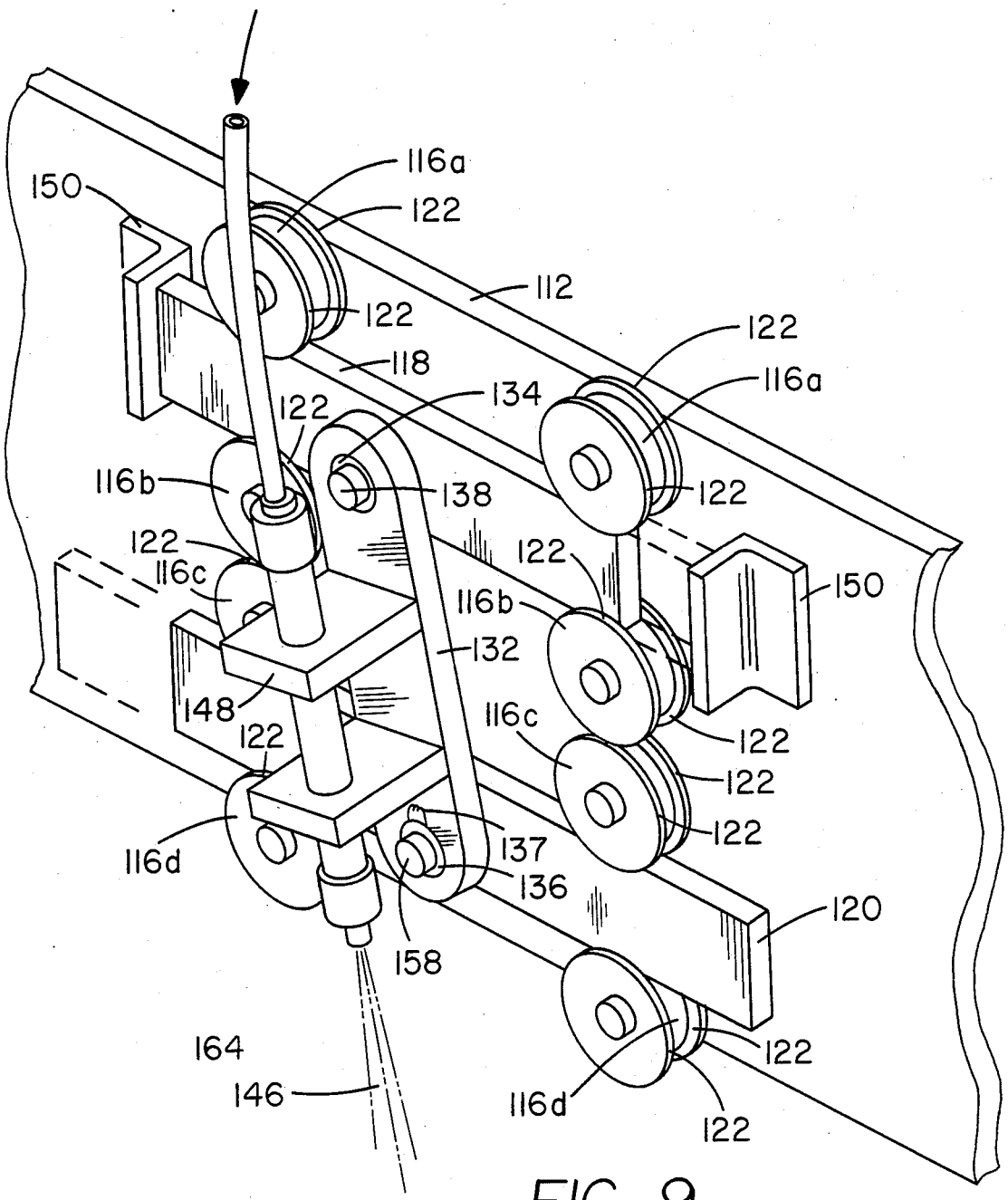
FIG. 9 is a side perspective view of an oscillation mechanism according to the present invention.

As shown in the embodiment of FIG. 9, the oscillation mechanism 108 has the left body member 112. The flanged rollers 116 are rotatably mounted to the body member 112. The first bar support 118 is held in place and guided by the two sets of rollers 116*a* and 116*b*. The second bar support 120 is held in place and guided by the two sets of rollers 116*c* and 116*d*. Each roller 116 has two flanges 122 which serve to hold and guide the bars 118 and 120.

The traverse bar 132 is pivotably connected to both the first bar support 118 (pivot point 134) and the second bar support 120 (pivot point 136). The movement of either bar will cause the traverse bar to pivot about both pivot points 134 and 136. The rollers 116*a* and 116*b* which are rotatably mounted to the body member 112 receive and hold the first bar support 118. The traverse bar 132 is pivotably mounted to the bar 118 by means of the pin 138 extending through the traverse bar 132 and into the bar 118. The traverse bar 132 is pivotably mounted to the support bar 120 by means of the pin 158 which pin is also movable in the lost motion slot 137 which is provided in the bar 32 to permit reversal of the direction of the bar supports and traverse bar.

In operation the mechanism 108 is so configured that movement of the bars produces the desired cyclical traversing effect. The movement of the mechanism 108 of FIG. 9 is similar to that of the movement of mechanism 8 of FIG. 1, although the stop members 150 shown in FIG. 9 are secured to the body member 112 rather than to a support bar. The dotted lines adjacent to the bars 118 and 120 indicate the extent of movement of these bars. The spray 146 is sprayed from the discharge device 148 which is mounted on the traverse bar 132.

In conclusion, therefore, it is seen that the present invention and the embodiments disclosed herein are well adapted to carry out the objectives and to obtain the ends set forth, as well as others inherent therein. Certain changes, apparent to one of skill in the art who has the benefit of this invention's teachings, can be made in the apparatus without departing from the spirit and scope of this invention as claimed.

What is claimed is:

1. Fluid spray apparatus with self-oscillating mount means comprising mount means for receiving and holding fluid discharge means, first support means supporting said mount means, said mount means pivotably connected to said first support means at a first pivot point, second support means supporting said mount means, said mount means pivotably connected to said second support means at a second pivot point spaced apart from the first pivot point, lost motion means for said second support means, for permitting reversal of direction of movement, and body member means, said first support means movably mounted on said body member means and said second support means spaced apart from said first support means and movably mounted on said body member means so that as fluid is discharged beyond the second support means the support means move on the body member means, the mount means thereby alternately transversing about the two pivot points.

2. The apparatus of claim 1 wherein each of the support means is a bar, the bars are spaced apart, and the bars are mounted and move parallel to each other.

3. The apparatus of claim 2, including restraining means, said restraining means comprising stop means on said body member means for contacting one or both bars to prevent further movement of said bar or bars in one direction.

4. The apparatus of claim 3, including also abutment means attachable to one or both bars for abutting the stop means.

5. The apparatus of claim 1, including frequency variation means for varying the frequency of movement of the support means across the body member means thereby varying the frequency of traverse of the mount means.

6. The apparatus of claim 5, wherein the frequency variation means includes damping means attachable to one of the bars.

7. The apparatus of claim 1 wherein roller means are mounted on the body member means for guiding and for facilitating the movements of the support means.

8. The apparatus of claim 7, wherein flanges are provided on the roller means for holding the support means in position with respect to the rollers.

9. The apparatus of claim 2, including also a plurality of flanged rollers mounted on the body member means for guiding and facilitating the movement of the bars, the bars maintained in position with respect to the rollers by the flanges thereon.

10. Fluid spray apparatus comprising mount means for receiving and holding fluid discharge means, said mount means having a first end and a second end, a first support bar, said mount means pivotably connected to and supported by said first support bar by a first pivot pin on the first end of said mount means, a second support bar supporting said mount means, said second end of said mount means pivotably connected to said second support bar by a second pivot pin spaced apart from the first pivot point, said second pivot pin movable in a slot in said second support bar to provide a lost motion connection for the second support bar, body member means, said first support bar movably mounted on said body member means and said second support bar spaced apart from said first support bar and movably mounted on said body member means so that as fluid is discharged beyond the second support bar the support bars move alternately on the body member means, the mount means thereby alternately traverses about the two pivot points, roller means mounted on the body member means for guiding and for facilitating the movements of the support bars, the roller means having flanges thereon for holding the support bars in position with respect to the rollers, frequency variation means connected to at least one of the support bars for varying the frequency of movement of the support bars across the bar member means thereby varying the frequency of traverse of the mount means, the frequency variation means comprising means for attachment to one of the bars, and stop means on said body member means for contacting one or both bars to limit the bar's movement and to prevent movement of said bar or bars in one direction.

11. Self-oscillation apparatus comprising mount means for receiving and holding fluid discharge means, traverse means, first support means supporting said traverse means, said traverse means pivotably connected to said first support means at a first pivot point, second support means supporting said traverse means, said traverse means pivotably connected to said second support means at a second pivot point spaced apart from the first pivot point, and lost motion means for said second support means permitting said second support means to change direction, body member means, said first support means movably mounted on said body member means and said second support means movably mounted on said body member means so that the support means are movable on the body member means in response to the force of the fluid discharge means and the traverse means is thereby alternately traversed about the two pivot points.

12. The apparatus of claim 11, wherein each of the support means is a bar, the bars are spaced apart, and the bars are mounted and move parallel to each other.

13. The apparatus of claim 12, including restraining means to prevent further movement of said bar or bars in one direction.

14. The apparatus of claim 13, including also abutment means attachable to one or both bars for abutting the stop means.

15. The apparatus of claim 11, including frequency variation means for varying the frequency of movement of the support means across the body member means thereby varying the frequency of traverse of the traverse means.

16. The apparatus of claim 15, wherein the frequency variation means includes means for attaching weights to one or the bars.

17. The apparatus of claim 11, wherein roller means are mounted on the body member means for guiding and for facilitating the movements of the support means.

18. The apparatus of claim 7, wherein flanges are provided on the roller means for holding the support means in position with respect to the rollers.

19. The apparatus of claim 12, including also a plurality of flanged rollers mounted on the body member means for guiding and facilitating the movement of the bars, the bars maintained in position with respect to the rollers by the flanges thereon.

* * * * *